US006672227B2

(12) United States Patent
Nordenberg

(10) Patent No.: US 6,672,227 B2
(45) Date of Patent: Jan. 6, 2004

(54) ARRANGEMENT FOR CLEANING, AIRFLOW CONTROL AND PUSHING AWAY MELT IN AIR PORTS OF INCINERATION BOILERS

(75) Inventor: Lennart Nordenberg, Vastra Frolunda (SE)

(73) Assignee: Kvaerner Pulping AB, Karlstad (SE)

( * ) Notice: Subject to any disclaimer, the term of this patent is extended or adjusted under 35 U.S.C. 154(b) by 26 days.

(21) Appl. No.: 10/204,174

(22) PCT Filed: Feb. 15, 2001

(86) PCT No.: PCT/SE01/00331

§ 371 (c)(1),
(2), (4) Date: Aug. 15, 2002

(87) PCT Pub. No.: WO01/61248

PCT Pub. Date: Aug. 23, 2001

(65) Prior Publication Data

US 2003/0010265 A1 Jan. 16, 2003

(30) Foreign Application Priority Data

Feb. 18, 2000 (SE) ..... 0000456

(51) Int. Cl.[7] ..... F23L 5/00; F22B 37/48; B08B 9/00

(52) U.S. Cl. ..... 110/182.5; 122/6.5; 122/6.6; 134/166 C

(58) Field of Search ..... 266/269; 432/75; 110/182.5; 122/6.5, 6.6, 269, 235 B; 134/166 R, 166 C, 169 R, 169 C

(56) References Cited

U.S. PATENT DOCUMENTS

| | | | | |
|---|---|---|---|---|
| 3,742,916 A | * | 7/1973 | Wessberg et al. | 122/390 |
| 3,875,904 A | * | 4/1975 | Astrom | 122/235 B |
| 3,900,011 A | * | 8/1975 | Stenlund | 122/235 B |
| 3,943,861 A | * | 3/1976 | AStrom et al. | 110/182.5 |
| 4,027,604 A | * | 6/1977 | Jansson | 110/182.5 |
| 4,653,409 A | * | 3/1987 | Ericksson | 110/182.5 |
| 4,822,428 A | * | 4/1989 | Goodspeed | 134/6 |
| 4,872,834 A | * | 10/1989 | Williams | 432/75 |
| 5,070,823 A | * | 12/1991 | Ackerman et al. | 122/379 |
| 5,167,192 A | * | 12/1992 | Pingel et al. | 110/182.5 |
| 5,531,189 A | * | 7/1996 | Shelton et al. | 122/379 |
| 5,983,930 A | * | 11/1999 | Nordenberg | 137/527.8 |

* cited by examiner

*Primary Examiner*—K. B. Rinehart
(74) *Attorney, Agent, or Firm*—Rolf Fasth; Fasth Law Offices

(57) ABSTRACT

The arrangement is for cleaning and controlling airflow and where appropriate pushing away melt in an air channel of recovery boilers within the paper and pulp industry. By inclining the regulating device 10 at an angle to the horizontal plane and at the same time making the piston of the regulating device run in contact with the side and upper walls 24*a*, 24*b* and, respectively, 22 of the air channel, optimum airflow control and a more compact installation can be achieved. The airflow can be adjusted more rapidly with a small regulating movement at the same time as very good penetration of the air into the furnace 4 is achieved.

8 Claims, 3 Drawing Sheets

ARRANGEMENT FOR CLEANING, AIRFLOW CONTROL AND PUSHING AWAY MELT IN AIR PORTS OF INCINERATION BOILERS

PRIOR APPLICATIONS

This application is a U.S. national phase application based on International Application No. PCT/SE01/00331, filed Feb. 15, 2001; which claims priority from Swedish Application No. 0000456-4, filed Feb. 18, 2000.

TECHNICAL FIELD

The present intention relates to an arrangement for cleaning, airflow control and for pushing away Melt from the opening of the airport in incineration boilers. The invention can preferably be applied for the abovementioned functions in principally but not exclusively the lower primary air ports in recovery boilers which are used for the chemical recovery process in paper pulp manufacture.

BACKGROUND AND SUMMARY OF THE INVENTION

From U.S. Pat. No. 3,742,916, an arrangement, marketed under the name RODDINGMASTER®, for cleaning and airflow control in air ports on boilers is previously known, in which cleaning and airflow control are brought about by a regulating and scraping sleeve which can be drawn in and out in the air port. Here, the sleeve is located on an essentially horizontally arranged regulating rod actuated by a regulating cylinder which is arranged outside the boiler and has a relatively large space requirement outside the recovery boiler.

The air regulation is effected by virtue of the fact that an annular gay is formed around the sleeve and the walls of the surrounding air port, which gap is imparted an increasing flow cross section when the sleeve is drawn out in the air port away from the recovery boiler. The flow cross section is closed when the sleeve has been pushed in towards the opening of the air port level with the wall of the recovery boiler, where the cleaning function is brought about when the edges or the sleeve scrape against the inner walls of the air port.

A disadvantage of this construction is that the air supply to the boiler is formed in an annular gap around the sleeve, which results in relatively weak penetration of the air jet into the boiler. For complete incineration of material supplied, it is of the utmost importance that the air which is supplied to the combustion process is distributed uniformly over the entire cross section of the boiler. The efficiency of the combustion process is absolutely vital in order for it to be possible to reduce emissions of inter alia NOx and CO and to minimize the risk of melt and liquor drops being carried off from the combustion chamber with the flue gases.

U.S. Pat. No. 3,875,904, U.S. Pat. No. 3,943,861 and U.S. Pat. No. 4,027,604 disclose further detailed improvements of the RODDINGMASTER® concept, namely sealing of the rear end of the sleeve, a common actuator for a number of sleeves and, respectively, telescopic regulating rods for the sleeve.

Regulating devices for air supply and integrated cleaning for airports of recovery boilers have formed the subject of a number of inventions. U.S. Pat. No. 4,653,409 and U.S. Pat. No. 5,070,023 disclose regulating devices with a cleaning function, in which the regulating cylinders are arranged essentially horizontally.

U.S. Pat. No. 4,583,552, U.S. Pat. No. 4,838,182 and U.S. Pat. No. 4,846,080 disclose variants in which the cleaning function is brought about via pivotable scrapers that can be swung out of the way so that they do not disrupt the airflow, These complicated mechanical solutions are, however, quite unsuitable for recovery boilers where there is a risk of the mechanisms being jammed by the environment of splashing melt.

U.S. Pat. No. 4,099,471 and U.S. Pat. No. 5,528,999 disclose other variants in which sliding sleeves for the cleaning function have been provided with pivotable dampers acting counter to the airflow through the interior of the sleeve in these constructions also, the dampers are exposed to melt splash and thus the risk of the damper function being jammed.

U.S. Pat. No. 4,545,308 and U.S. Pat. No. 4,940,004 disclose air port constructions which are intended to provide maximum penetration of the air jet and in which the inlet itself to the boiler is given a narrow nozzle-shaped design. These solutions mean, however, that the regulating body itself has to be drawn out very far from the wall opening in order for a substantial flow to be developed, as a result of which there is a considerable space requirement around the boiler.

The prior art has suffered from one or more disadvantages with regard to:

- the space requirement around the boiler for the regulating equipment,
- a large regulating stroke for regulating between minimum and maximum airflow,
- a complicated mechanical constructions not suitable for the environment,
- a poor degree of penetration of the air jet brought about by the regulating device,
- a limited possibility of, in the same regulating device, also being able to push away slag from the air inlet in the event of a high level of melt in the boiler.

The object of the invention is to bring about air control and cleaning of of the airport using one and the same mechanism, in which the air control is carried out in order to maintain in a simple manner the degree of penetration of the air that is supplied to the furnace of the boiler.

Another object is to make it possible for the combustion air to be supplied better over the entire cross section of the boiler, at the same time as the time the combustion gases remain in the boiler can be kept relatively long, which results in better combustion and reduction of the risk of liquor drops and melt being carried off from the combustion chamber with the flue gases.

At the same time, when the invention is applied in the lower air ports, an improved possibility can be obtained for pushing melt/slag away from the air port in the event of a high melt level.

In a preferred embodiment, the arrangement is arranged so that it occupies less space outside the boiler than constructions that are already in existence/use. The invention also brings about three-fold functionality with a minimum number of components which results in a very cost-effective solution.

Another object is that the construction is to be robust and not to have complicated mechanisms that risk becoming locked if they ate exposed to splash from the melt.

A further object is for it to be possible for the airflow to be adjusted more rapidly with a small regulating movement. By means of the invention, airflow regulation, cleaning and pushing away melt/slag can be achieved at the lowest possible coat and with great operational safety.

DETAILED DESCRIPTION

Figure 1:
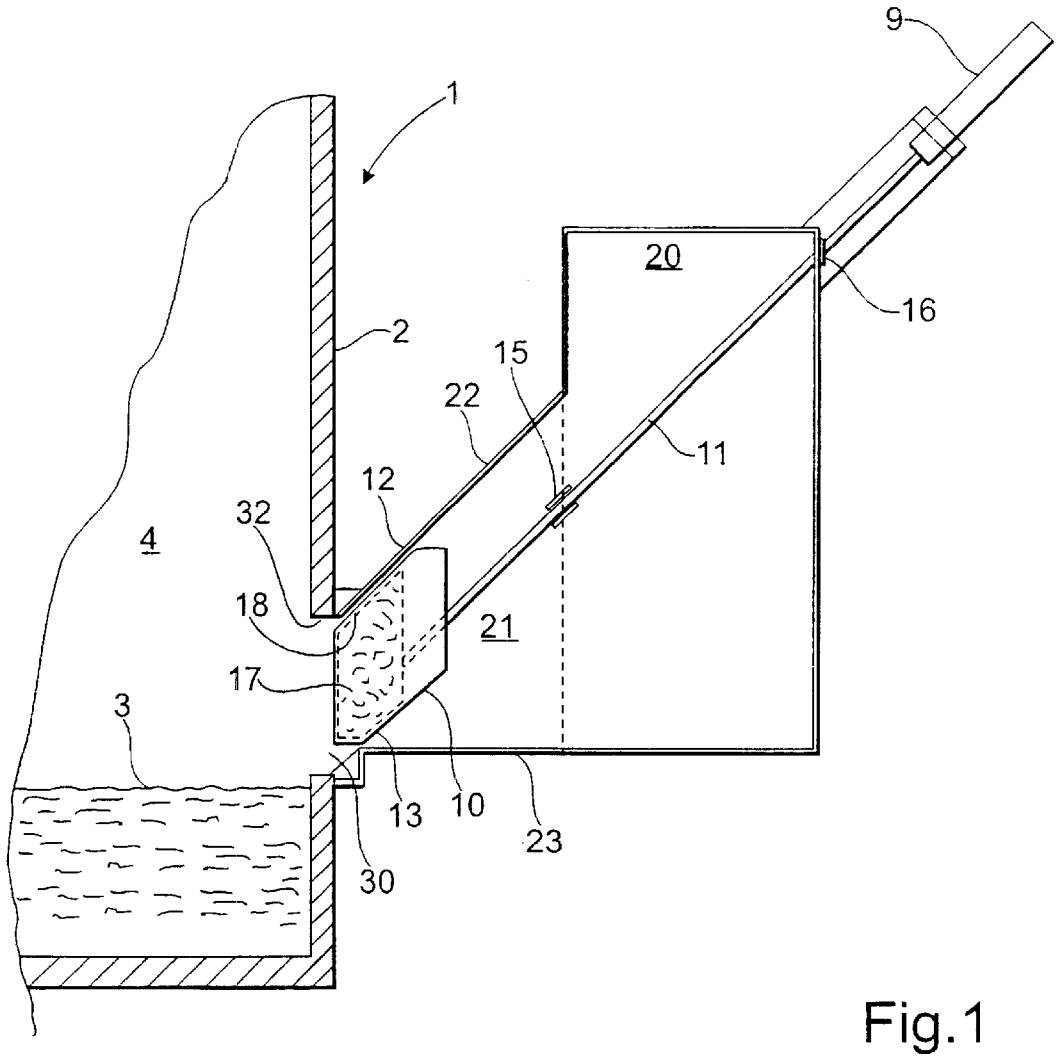
FIG. 1 Shows diagrammatically a vertical sectional view through a recovery boiler with an arrangement according to the invention.

FIG. 1 shows an arrangement according to the invention arranged at the air opening 30 in the wall 2 of an incineration boiler. The incineration installation is preferably a recovery boiler in which residual products from the manufacture of paper pulp are incinerated, and chemicals for the cooking process can be recovered from the melt extracted. In the furnace, a melt level 3 is formed in the bottom of the boiler, and a lower air port level for the supply of primary air is arranged directly above the melt level. The actual boiler with its furnace is often 15–60 meters high, and combustion air is supplied at a number of levels up through the furnace.

After the supply of primary air, the following are supplied:

secondary air, 1–3 meters above the primary air addition, high secondary air, a further 1–2 meters above the secondary air addition, tertiary air, added 5–11 meters above the primary air supply, and quaternary air, added 9–18 meters above the primary air supply.

For air ports at all these levels, a need exists for both cleaning and airflow control according to the invention.

The air ports are exposed to a great deal of splash from the melt, black liquor and dust, which gives rise to the risk that air regulating devices may become jammed. At the same time, the air regulation gaps must be kept clean. FIG. 1 shows a vertical air shaft 20 which feeds combustion air to air ports 21 which adjoin the wall 2 of the boiler. The air port 21 has an upper wall 22 which is inclined at 45° from the wall of the recovery boiler and up towards he air shaft 20. The lower wall 23 of the air port runs essentially horizontally from the wall 2 of the recovery boiler and out towards the air shaft 20. The air port 21 is delimited laterally by two essentially parallel, plane walls 24*a*, 24*b* (see FIG. 3). The air port therefore extends between the air shaft 20 and the air opening 30 arranged in and parallel to the wall 2 of the recovery boiler.

Arranged inside the air port 21 is a regulating device 10 which is mounted on the end of a regulating rod 11 which is in turn actuated by servo means 9. The servo means 9 can suitably be a direct-acting pneumatic cylinder or an electric motor that, via a worm gear, actuates the regulating rod via a rack integrated with the regulating rod. The regulating rod is suspended in such a manner at two bearing points 15, 16 arranged in the walls of the air port that the regulating rod runs essentially parallel to the upper wall 22 of the air port by means of this suspended mounting, the a servo means 9 can actuate the regulating device 10 so that the regulating device moves in a direction at 45° in relation to the horizontal plane and inclined upwardly and outwardly from the interior of the recovery boiler.

Figure 2:
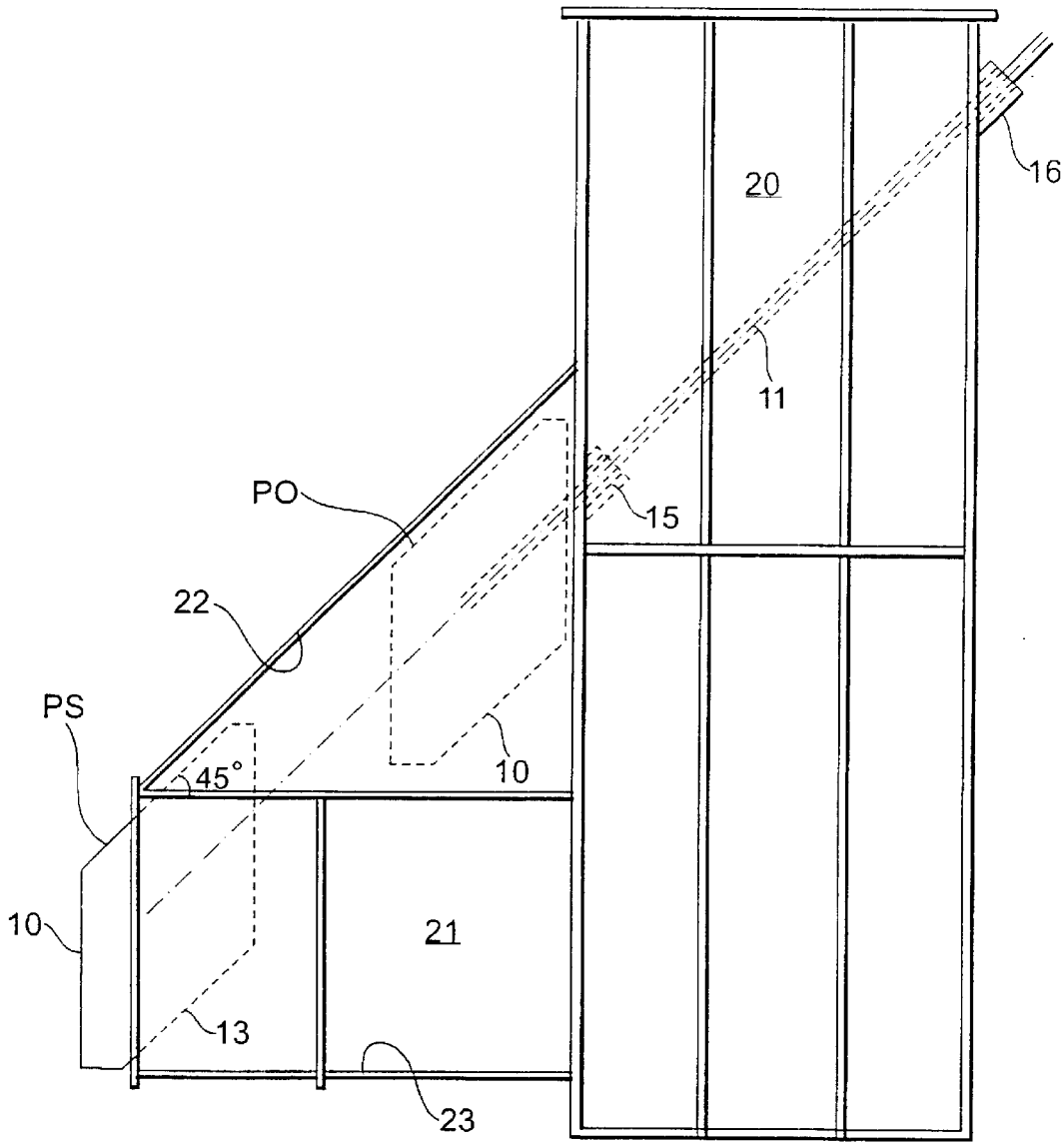
FIG. 2 shows the arrangement according to the invention seen in the same view as in FIG. 1, with the regulating device indicated in two positions.

FIG. 2 shows the arrangement seen in the same view as in FIG. 1. The regulating device 10 is shown here in two alternative positions, position PS in which the air opening 30 is closed and position PO in which the regulating devices 10' has been drawn back to its maximum extent. In position PO, the airflow out to the air port opening is completely unrestricted from the air shaft 20, via the air port 21, which air port has essentially at least the same flow cross section from the shaft 20 and out through the opening 30.

Figure 3:
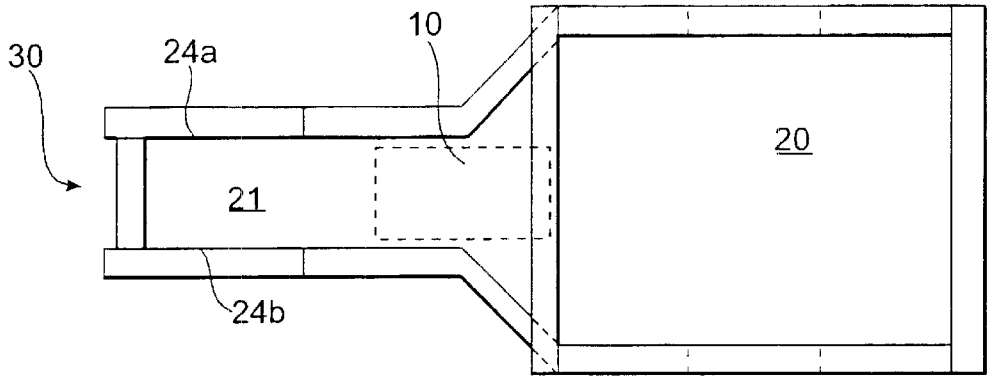
FIG. 3 shows the air port seen in a view from above in FIG. 1.

FIG. 3 shows the arrangement in a view from above in FIGS. 1 and 2. The regulating device 10 is shown here in the drawn-back position PO. The airflow is led down in the air shaft 20, into the figure, and on out to the left in the figure via the air port 21 and its opening 30 to the furnace 4.

Figure 4:
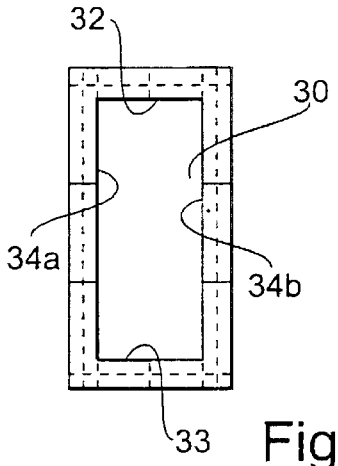
FIG. 4 shows the air port in the wall of the boiler.
Figure 5:
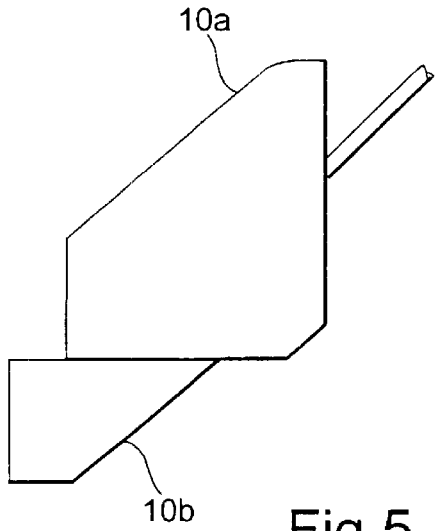
FIG. 5 shows diagrammatically a variant of the invention with a divided regulating device.

In the embodiment shown, the regulating device is a piston of rhombic shape, the outer shape of which is congruent with the through-flow area of the air opening, see FIG. 4, and is thus made in such a manner that the piston can pass freely through the air duct and its opening 30. In the embodiment shown, the delimiting walls of the regulating device are all plane, but this is not absolutely necessary. In an alternative variant, the Upper and/or lower delimiting surface 12 and, respectively, 13 of the regulating device 10 can have a convex shape, curved around an axis parallel to the regulating rod 11, the corresponding upper and lower walls In the air port 21 of course being given a congruent concave shape in a corresponding manner.

The upper delimiting surface 12 of the regulating device moves parallel to the upper wall 22 of the air port and with an essentially constant spacing being maintained between them during the entire movement of the regulating device into or out from the air opening 30.

The lateral delimiting surfaces 14*a*, 14*b* of the regulating device interact in a similar manner with the side walls 24*a*, 24*b* of the air port, with an essentially constant spacing being maintained between them during the entire movement of the regulating device into or out from the air opening 30. In this way, essentially the entire airflow that enters the furnace via the air opening 30 will be formed below the regulating device, between its lower delimiting surface 13 and the lower wall 23 of the air port.

The constant spacing between the upper wall and the two side walls and the regulating device is to be kept as small as possible so as to ensure that the main airflow is formed below the regulating device, for maximum penetration capacity. A certain small leakage flow can nevertheless be accepted for cooling purposes, but this leakage flow is to correspond to only fractions of the total airflow into the furnace during normal operation. In order to improve to some extent the cooling effect, a number of cooling ducts can also be incorporated in interacting walls or through the piston, filling material 17 etc. of the regulating device. These cooling ducts can be brought about via through-bores in the regulating device, or via ducts in the walls of the regulating device/air port.

The outer end of the regulating device, directed towards the furnace, preferably has a cup-shaped recess/filling chamber which can contain a heat-resistant mass (tamping mass). The outer contours of the regulating device then form edges directed towards the interior of the furnace and parallel to the walls of the air port, which surround the mass and form sharp scraping edges which engage with the edges of the air port when the regulating device is actuated in the direction of the furnace.

The regulating rod 11 of the regulating device is to be of such a length that the servo means 9 can guide the outer edges of the regulating device past the air port and into the furnace, preferably in such a manner that the outer end of the regulating device is, when pushed into the furnace to its maximum extent, arranged below a horizontal plane containing the lower wall of the air port, the outer end then lying at least 2–10 cm below the Lower edge of the air port. In this way, the regulating device can be used in order to penetrate down towards the upper surface of the melt and push away the melt bed or slag which has built up at the lower edge of the opening 30 of the air port, as otherwise the bed or the slag can impair the airflow into the furnace.

In an alternative embodiment, the lower rhombic piston of the regulating device can be divided in a horizontal plane into an upper and a lower section, 10*a* and, respectively, 10*b*. The upper section 10*a* then bears/scrapes against the upper wall of the air port and 40–60% of the side A walls, and the lower section 10*b* bears/scrapes against the lower wall of the air port and 60–40% of the side walls. When the regulating device reaches the position when the air opening 30 is essentially closed, a transfer mechanism (not shown) can bring about a relative movement between the upper and lower sections, whereupon the lower section 10*b* can be imparted a movement horizontally into the furnace. An example of a transfer mechanism might be an actuating rod parallel to the regulating rod 11, which, only in the lower position of the regulating device, is rotated and pushes the lower section. Another variant night be a atop heel for the upper section, in which case further operation of the regulating rod actuates only the lower section. Variants are also possible in which a relative movement is brought about in the sliding plane between the upper and lower sections when the lower section reaches the lower wall of the air port.

While the present invention has been described in accordance with preferred compositions and embodiments, it is to be understood that certain substitutions and alterations may be made thereto without departing from the spirit and scope of the following claims.

What is claimed is:

1. An arrangement for cleaning and controlling an airflow in an incineration installation, comprising:

an incineration installation having a melt disposed therein, the installation having an air channel defined therein for leading air to a furnace of the incineration installation, the furnace having a furnace wall having an air opening defined therein, the air channel being in fluid communication with the furnace via the air opening, the air opening being defined by two essentially vertical and mutually parallel delimiting edges, a lower delimiting edge and an upper delimiting edge;

a regulating device arranged in the air channel, the regulating device having a shape congruent with a shape of the air channel, the regulating device having two essentially vertical and mutually parallel delimiting walls, a lower delimiting wail and an upper delimiting wall;

servo means for moving the regulating device into and out from the furnace through the air opening, the upper delimiting wall of the regulating device being immediately adjacent an upper wall of the air channel, the servo means imparting, via an elongate regulating rod, a movement to the regulating device in a plane arranged at an angle relative to a horizontal plane; the regulating device being attached to the regulating rod and is imparted a movement into or away from the air opening and an interior of the furnace;

the upper delimiting wall and the vertical delimiting walls of the regulating device maintaining an essentially constant first distance from the upper wall of the air channel during movement of the regulating device within the air channel, a second distance being formed between the lower delimiting wall of the regulating device and the lower wall of the air channel so that substantially all controlled air flow flowing from the air channel into the furnace flows below the lower delimiting wall of the regulating device and a lower wall of the air channel.

2. The arrangement according to claim 1 wherein the delimiting walls of the regulating device are plane.

3. The arrangement according to claim 1 wherein characterized in that the angle between the movement of the regulating device and the horizontal plane is about 45°.

4. The arrangement according to claim 1 wherein the regulating device and the air opening have a rhomboid shape.

5. The arrangement according to claim 4 wherein the regulating device has a piston with a front wall facing the furnace, the front wall has a scraping edge.

6. The arrangement according to claim 1 wherein the lower delimiting wall of the regulating device has a section close to the furnace that is essentially horizontal and the lower wall of the air channel is horizontal.

7. The arrangement according to claim 1 wherein the regulating device has an upper section and a lower section that are movable relative one another.

8. The arrangement according to claim 7 wherein the lower section is movable in a horizontal direction that is different from a movement of the regulating rod.

* * * * *